United States Patent [19]

Sloan

[11] Patent Number: 4,480,534

[45] Date of Patent: Nov. 6, 1984

[54] GRAIN BIN ROOF VENT

[75] Inventor: Craig Sloan, Shelby County, Ill.

[73] Assignee: Grain Systems, Inc., Assumption, Ill.

[21] Appl. No.: 437,893

[22] Filed: Nov. 1, 1982

[51] Int. Cl.[3] ..... E04H 7/00

[52] U.S. Cl. ..... 98/55; 52/199; 52/200

[58] Field of Search ..... 98/37, 42 A, 76, 42 R, 98/55, 114; 285/423, 424, 42, 43, 405; 52/199, 200, 219, 58

[56] References Cited

U.S. PATENT DOCUMENTS 2,703,060 3/1955 Kiefer ..... 52/200 X 4,214,511 7/1980 Mueller ..... 98/37

*Primary Examiner*—William E. Wayner

*Assistant Examiner*—J. Sollecito

[57] ABSTRACT

A roof vent (or other opening closure means) for a grain bin is disclosed. Generally, a grain bin has a cylindrical bin body and a conical roof. The roof includes a plurality of wedge-shaped panels secured together in side-to-side relation and often one or more of these panels has an opening therein for accommodating a roof vent. A flange is provided on the roof panel defining an opening in the roof panel with the flange being sealably (preferably integrally) formed with the roof panel. The flange extends outwardly so as to prevent water flowing down the slope of the roof from entering into the opening.

2 Claims, 13 Drawing Figures

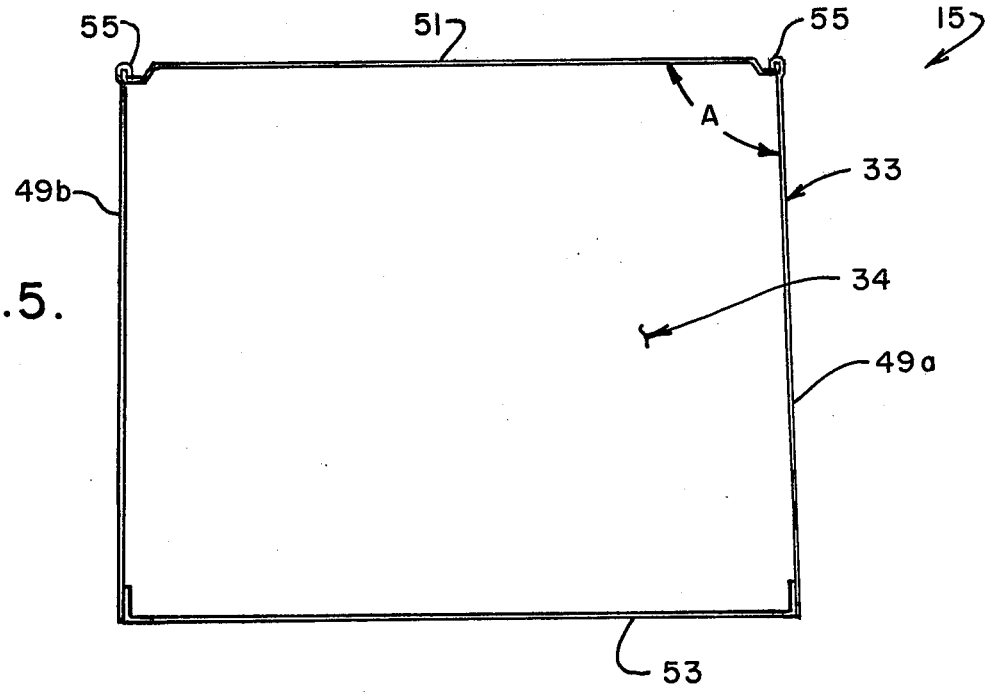
FIG. 5.
FIG. 6.
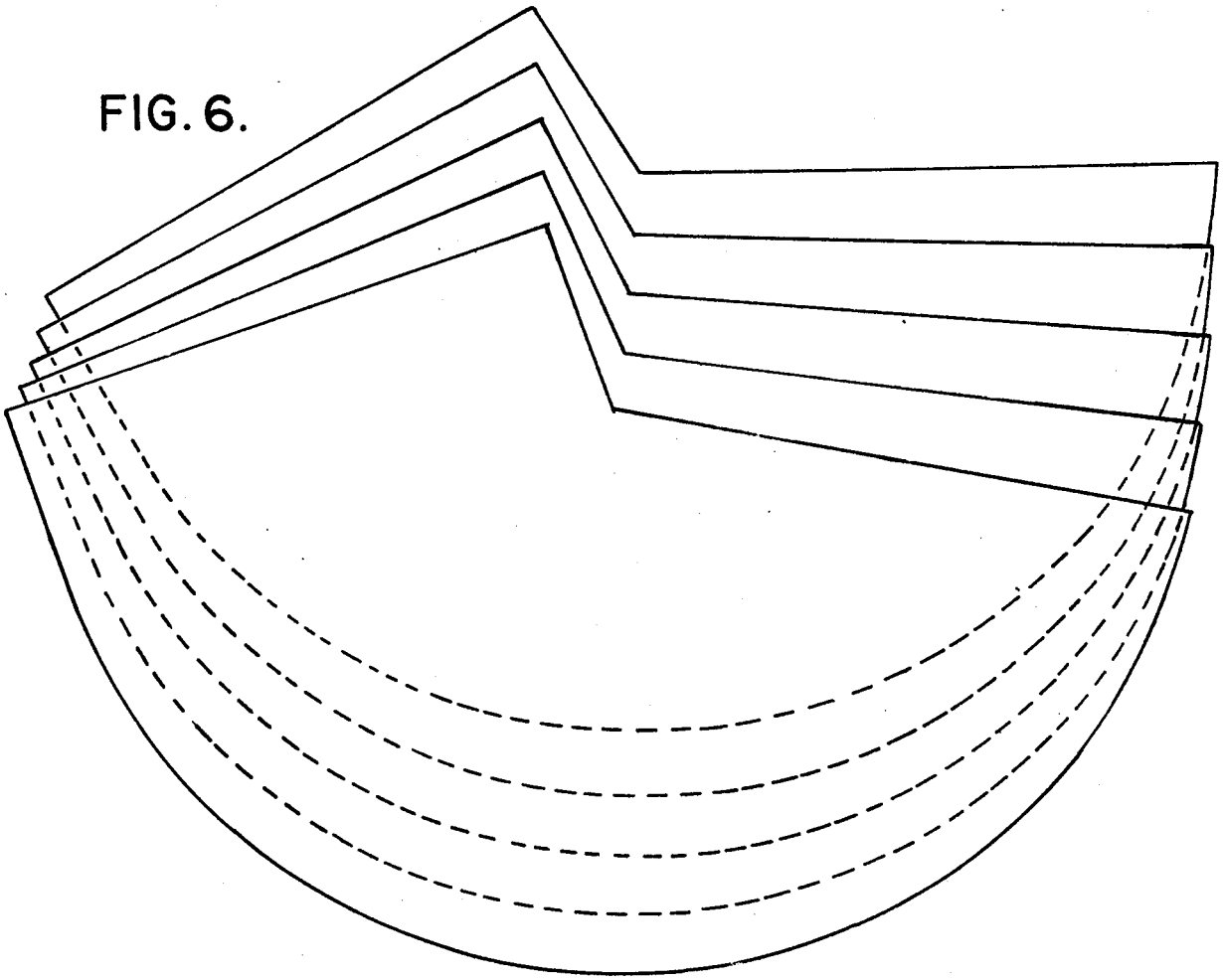

GRAIN BIN ROOF VENT

BACKGROUND OF THE INVENTION

This invention relates to a grain bin which is typically used for on-farm grain conditioning and storage purposes. Even more specifically, this invention relates to the construction of a grain bin having a roof vent or other opening in the roof of the grain bin which is specifically constructed so as to avoid rainwater or the like flowing down the slope of the roof of the grain bin from entering the bin.

In recent years, it has become conventional for farmers to condition (i.e., dry) and to store at least a certain portion of their grain crops (e.g., corn, soybeans, rice, or wheat) in on-farm storage bins. Conventionally, on-farm grain storage bins comprise a generally cylindrical-shaped bin made of sheet metal panels which are mounted on a concrete foundation slab. These bins may vary considerably in diameter and height so as to accommodate a wide variety of quantities of grain which may be stored therein. The grain bin typically further includes a conical-shaped roof made of a plurality of sheet metal, wedge-shaped roof panels which slope upwardly and inwardly from the outer upper surface of the cylindrical bin and which are secured together at the upper center of the roof by means of a peak collar. Oftentimes, this peak collar serves as the entry point into which grain is loaded into the bin by means of a grain spreader suspended from the peak collar.

Further, a grain bin which is used to condition (dry) grain often includes a perforated floor raised above the concrete foundation slab such that an air plenum exists under the floor. This plenum is typically in communication with a fan system and a heater for blowing heated air into the plenum. This heated air is then forced up through the perforated floor, through the grain and is exhausted through the peak collar and also through one or more roof vents provided in the roof of the grain bin. Of course, it is necessary that there be sufficient vent area in the bin to allow the heated air carrying the moisture from the grain to readily escape thereby to permit the moisture to be expelled and to prevent the undue buildup of static pressure within the grain bin.

Typically, prior art roof vents were generally of rectangular cross-section and were installed on selected of the roof panels such that the roof vent was in communication with the interior of the grain bin. The roof vent faces generally downwardly away from the peak of the roof so as to prevent rainwater and the like from entering the bin through the exhaust opening. The exhaust opening is covered with a screen so as to prevent birds and other animals from entering the bin.

However, there have been several longstanding problems associated with prior roof vents. One such problem was that it was a relatively difficult matter to effectively seal the roof vent relative to the roof panel on which it was installed so as to prevent rainwater and condensation from running down the outer surface of the sloped conical roof and from entering the grain bin via the opening provided in the roof panel for the roof vent. In certain prior roof vent designs, an opening was field cut in a selected roof panel and the roof vent was bolted to the roof panel adjacent the opening. A mastic-like sealant was used to seal the roof vent to the roof panel.

In other prior art roof vents (see FIGS. 10 and 11), the roof vents had flanges which mated in face-to-face relation with the outer surface of the roof panel and an extension which protruded into a hole field-cut into a selected roof panel by field installation personnel. Caulking material was applied between the roof panel and these flanges. The extensions protruding into bin through the opening are then bent over on the inside of the roof panel so as to sandwich the roof panel between the flange on the bent over extension. Self-tapping metal screws were then inserted through the flange, the roof panel and the bent over extensions.

However, with both of the above-described prior art roof vents, the mastic served as the only seal. Also, due to improper installation of the roof vent such as may be caused by improperly sized or improperly cut openings in the roof panels, due to the tendency of the caulking material to crack over time (which may in part be the result of both the roof panels and the roof vents being of light gauge sheet metal and thus being subject to flexing), these prior art roof vents oftentimes leaked. The requirement of having to field cut the openings in the roof panels oftentimes resulted in oversize and undersize openings which in turn lead to leaking roof vents. Still further, with the advent of longitudinal corrugations in the roof panel, it was difficult for the mastic to effectively seal the roof vent.

As heretofore mentioned, prior roof vents were generally of rectangular cross section. While it was highly advantageous to ship the roof vents in an assembled form so that they may be readily installed on the grain bin in the field, these roof vents were relatively large in size and thus required a substantial shipping container and posed a disadvantage in shipping in that they took up considerable volume while having little weight. Still further, prior pre-assembled roof vents, due to their large size and sheet metal construction, were subject to damage during transport from the factory to the on-farm installation site.

SUMMARY OF THE INVENTION

Among the several objects and features of this invention may be noted the provision of an opening in a roof panel of a grain bin for receiving a roof vent or other structure, the roof panel being so constructed as to positively prevent runoff water from entering the grain bin, even in the event of a failure of caulking or other sealant materials;

The provision of a roof vent for a grain bin which may be transported in a partially assembled condition and in which a plurality of the roof vents of similar size may be nested one within the other during transportation;

The provision of a roof vent which does not rely solely on caulking or other sealant or gasket materials to prevent leakage of rainwater into the grain bin via an opening in the bin roof for the roof vent;

The provision of such a roof vent in which the openings for the roof vents are preformed in the roof panels and thus the necessity of field cutting the roof vent openings is eliminated;

The provision of such a grain bin roof panel which is not unduly subject to damage during shipping of the grain bin;

The provision of such a roof vent for a grain bin which conserves space during shipping and which may be readily installed during construction of the grain bin; and The provision of a grain bin which, during installation of the roof vents, requires no field cutting or drilling, which is convenient to assemble, and which, during its service life, insures that all rain water and condensation running down the roof panel is diverted away from the opening in the roof panel.

Other objects and features of this invention will be in part apparent and in part pointed out hereinafter.

Briefly stated, a grain bin has a generally cylindrical body and a conical roof. The roof typically comprises a plurality of roof panels secured together in side-by-side relation and at least one of these roof panels has an opening therein for accommodating a roof vent or other structure, such as a manway or the like. More specifically, the improvement of this invention is defined to comprise a flange sealably secured, preferably integrally formed, on the above-stated at least one roof panel with the flange projecting outwardly of the roof panel thereby to define the opening. The flange thus positively prevents water from flowing down the outside of this one roof panel and from entering the opening.

Still further, this invention relates to a roof vent for a grain bin, such as defined above, in which the roof vent has an air passage extending therethrough with the inlet to the roof vent being substantially perpendicular to the roof and with the roof vent being curved back on itself so that the outlet of the air passage through the roof vent faces generally downwardly toward the roof panel. The body of the roof vent comprises a pair of spaced side panels, a back panel secured to the side panels, and one or more removable front members. The vent body is generally trapezoidal in cross-section and the front is wider than the back panel so that with the front members removed, a plurality of the vent bodies can be nested one within the other so as to facilitate shipping of the roof vents in an assembled condition.

BRIEF DESCRIPTION OF THE DRAWINGS

FIG. 5 is a bottom view of the roof vent body, as viewed along line 5—5 of FIG. 3 illustrating the trapezoidal cross section of the roof vent;

FIG. 6 is a side elevational view of a plurality (e.g., five) of partially assembled roof vent bodies nested one within the other for compact shipping thereof;

Corresponding reference characters indicate corresponding parts throughout the several views of the drawings.

DESCRIPTION OF PREFERRED EMBODIMENTS

Figure 1:
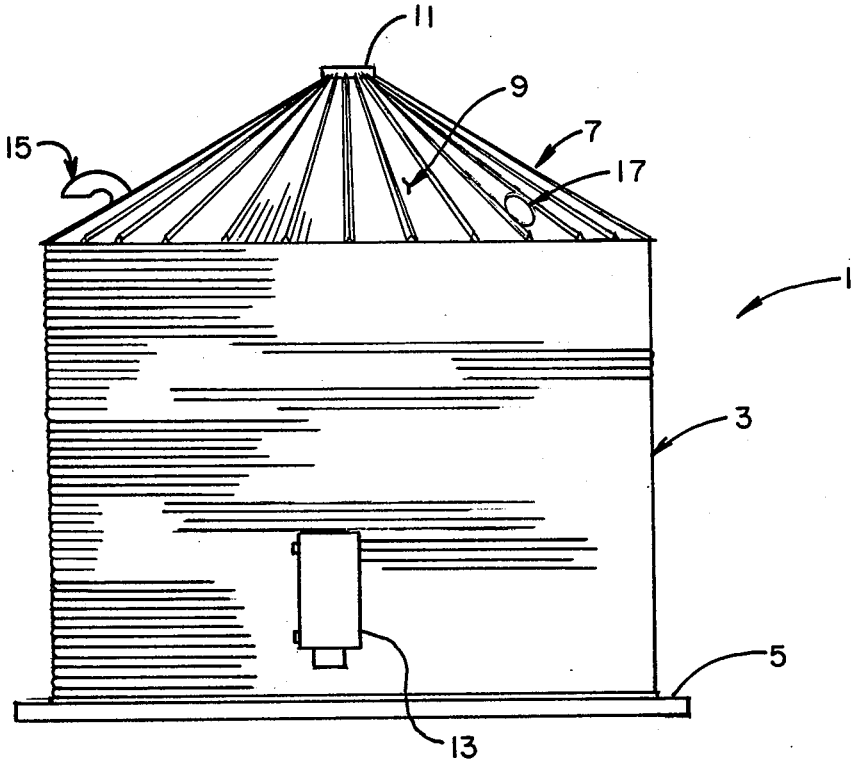
FIG. 1 is a front elevational view of a typical on-farm grain bin having a cylindrical bin body with a conical roof, the grain bin being mounted on a slab foundation and having a roof vent and a manway mounted on the roof thereof.

Referring now to the drawings, in FIG. 1, a conventional grain bin is indicated in its entirety by reference character 1. As is typical, the grain bin includes a cylindrical bin body 3 formed of a multiplicity of sheet metal, corrugated panels bolted together and mounted on a concrete slab or foundation 5. A conical roof, as generally indicated at 7, made up of a plurality of wedge-shaped roof panels 9 bolted together along their edges forms the roof for the grain bin. The upper, inner ends of roof panels are joined to a peak collar 11 thus constituting the central securement point for the inner ends of the roof panels. Also, this peak collar defines a central opening through which grain may be readily loaded into the grain bin. As indicated at 13, a bin door is provided in the grain bin so as to permit ready access into the bin when it is empty. As generally indicated at 15, a roof vent, made in accordance with this invention, is shown be located on one of the roof panels distal from peak collar 11 and generally adjacent the outer end of the roof panel. While only one roof vent 15 is shown on grain bin 1, it will be understood that a typical bin may have three or more of these roof vents so as to provide a sufficient vent area during conditioning (drying) of the grain. As indicated at 17, a so-called manway is provided which permits personnel entry into the grain bin when it is filled. It will be appreciated that numerous other accessories typically provided on a grain bin, such as ladders, bin eave platforms and the like, have been omitted from the instant description of grain bin 1 for purposes of clarity as they are not, per se, a part of the instant invention.

Figure 2:
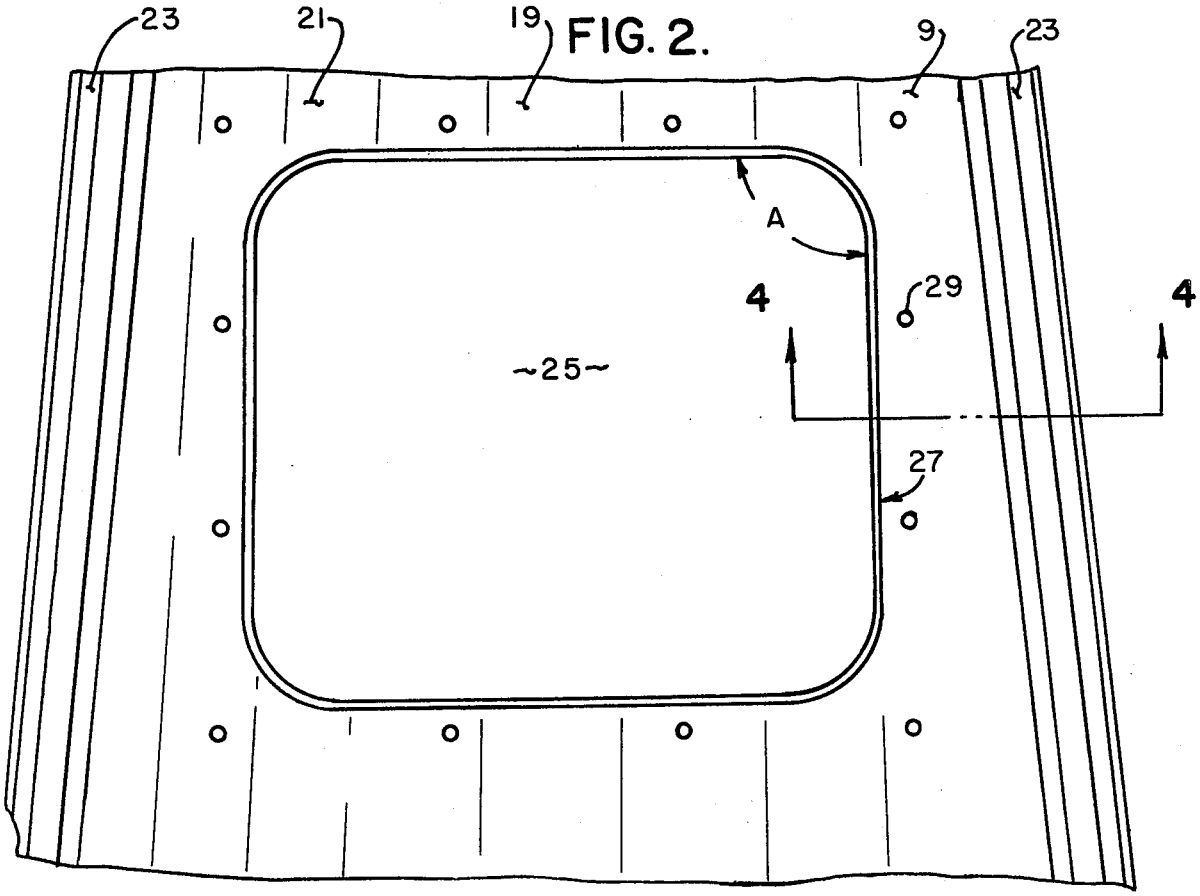
FIG. 2 is a top plan elevational view of a portion of a panel comprising the roof of the grain bin illustrating an opening in accordance with this invention for the installation of a roof vent or other closure for the opening.

Referring now to FIG. 2, a portion of the selected one roof panel 9 on which roof vent 15 is mounted is shown in enlarged scale. More specifically, this roof panel includes a panel body, as indicated at 19, which is typically made of sheet metal and which is preferably galvanized for corrosion resistance. The gauge thickness of the roof panel may vary, depending on the diameter of the grain bin. While the grain bin 1 and the conical roof 7 are typically made of sheet metal construction, it will be understood that other materials, such as sheet fiber reinforced plastic or the like, may be utilized within the broader aspects of this invention.

Figure 3:
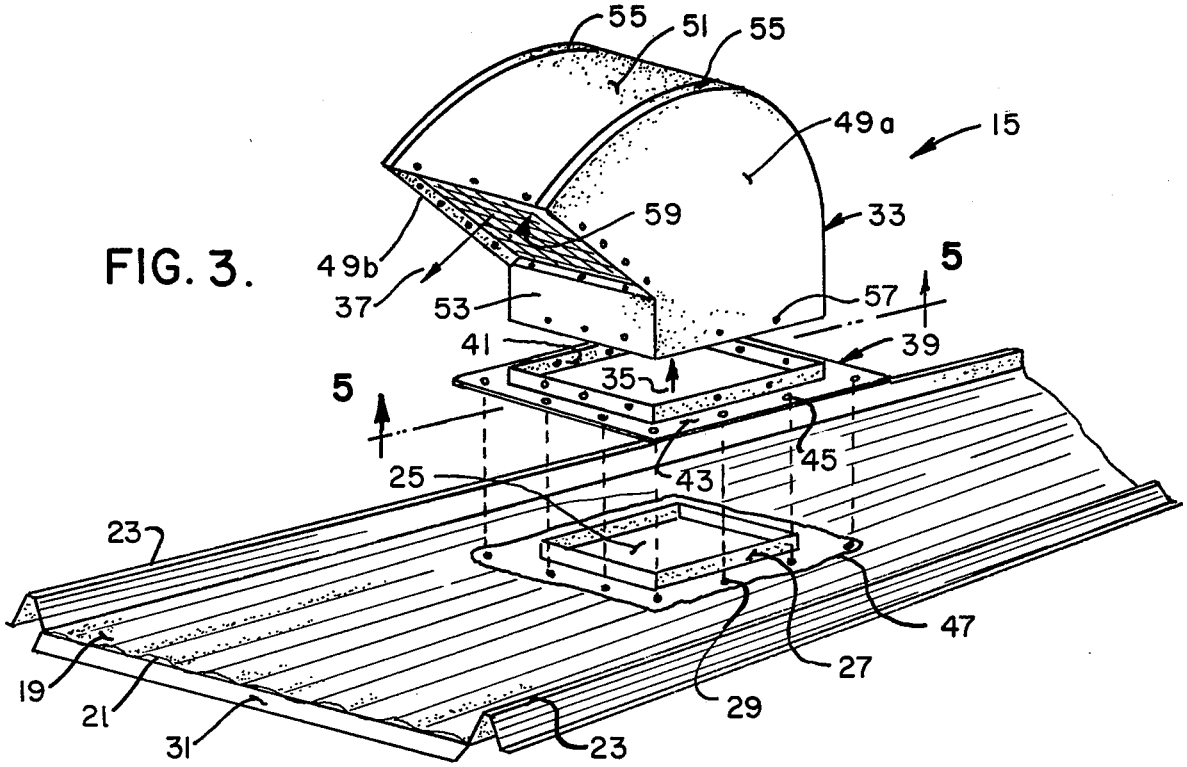
FIG. 3 is a partially exploded perspective view of a roof panel illustrating a flange sealably secured (preferably integrally formed) with the roof panel and projecting outwardly therefrom defining an opening in the roof panel and further illustrating a roof vent in accordance with this invention for being sealably installed on the outer surface of the roof panel with the roof vent in register with the opening.
Figure 4:
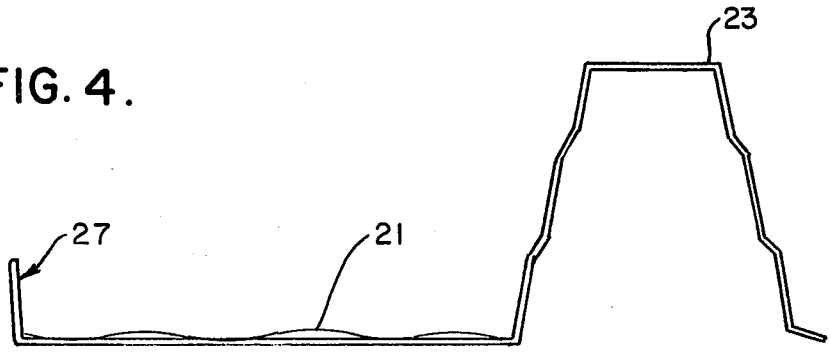
FIG. 4 is an enlarged cross-sectional view taken along line 4—4 of FIG. 2 illustrating the flange sealably or integrally formed on the roof panel defining the opening therein and further illustrating a roof vent installed on the roof panel in accordance with this invention.

As indicated at 21, longitudinal corrugations may optionally be provided on roof panel body section 19 so as to provide additional rigidity in lengthwise direction to the roof panel 9. At each lateral side of the roof panel, so-called channel-shaped stringers 23 (as best shown in FIGS. 3 and 4) are provided. It will be understood that one of the channel-shaped stringers 23 of one panel is fitted over in interlocking relation with the adjacent stringer of a contiguous roof panel such that all of the roof panels are interlocked together by means of the overlapping stringers. These overlapped and interlocked stringers provide substantial reinforcement for roof 7 and prevent leakage of rainwater into the bin. Fasteners (not shown) may be utilized to join the stringers together. Of course, means other than stringers 23 may be employed to secure the panels together. However, it will be understood that the particular means used to secure the roof panels together does not, per se, constitute a part of this invention, and thus any suitable means may be employed.

As indicated generally at 25, an opening for roof vent 15 is preformed in roof panel 9. Normally, one roof panel 9 with opening 25 preformed therein will be provided for each of the roof vents 15 to be installed on grain bin roof 7. This opening 25 is defined by means of a one-piece flange 27 which is sealably secured to panel body 19 and which projects outwardly above the outer surface of panel body 19 and which extends continuously around opening 25. As shown in FIGS. 2–4, flange 27 is preferably integrally formed in the sheet metal roof panel body 19 of roof panel 9 by means of a die forming operation during fabrication of the roof panel and thus there is no gap or opening between the flange and the roof panel body or at the corners of the flange through which moisture (e.g., rainwater runoff) can flow around and enter the inside of the bin via opening 25. However, within the broader aspects of this invention, it will be understood that flange 27 may be sealably secured to roof panel body in a manner other than die forming. For example, the flange may be welded to panel body 19, or the flange may be formed of a suitable synthetic resin material and sealably bonded in place to the roof panel. Thus, those skilled in the art will recognize that flange 27 may be sealably secured to panel body in any suitable manner. As indicated at 29, a plurality of bolt holes is provided in roof panel body 19 around opening 25 for purposes as will appear. In addition, as indicated at 31, roof panel 9 includes a flashing lip 31 at its bottom end which extends out beyond the periphery of the outer edge of the cylindrical grain bin 3 so as to prevent rainwater or the like from flowing around the edge of the end panel and entering the top of the grain bin.

Referring now to FIG. 3, roof vent 15 of the present invention is shown in a partially exploded view. The roof vent includes a body, as generally indicated at 33, having an air passage 34 extending therethrough with the bottom end of the roof vent body defining an inlet 35 for air passage 34 and an outlet 37 for the air passage. Further, roof vent 15 includes an integral, die-formed base frame, as generally indicated at 39, with the base frame having vent flanges 41 integral with and extending generally upwardly from base flashing flanges 43 for reception within the inlet opening of body 33 of the roof vent. Flashing flanges 43 extend generally laterally outwardly from vent flanges 41 so as to mate in generally face-to-face relation with the outer surface of panel body 19 of roof panel 9. Thus, the integrally formed base frame 39 positively prevents water from leaking into the bin via cracks or joints between base flanges 41 and flashing flanges 43. Flashing flanges 43 include a series of bolt holes 45 which mate with bolt holes 29 in panel body 19 and which receive bolts B or other fasteners for securing the base frame to the outer surface of panel body 19. As indicated at 47, a bead of suitable caulking or mastic-like material is preferably applied to the outer surface of panel body 19 prior to securing base frame 39 to the roof panel thereby to provide, at least in part, a seal between the base frame and the outer surface of the plate. However, it will be appreciated that because of the longitudinal corrugations provided on the body panel, this mastic caulking material may not, in all cases, provide a watertight seal, especially over time when there is considerable flexing of the bin roof and vent due to changes in temperature, in changes of the internal air pressure conditions within the bin, and in changes (shrinking) changes of the mastic material.

As best shown in FIGS. 3 and 5, roof vent body 33 includes a pair of side panels 49*a*, 49*b* which are permanently joined to a curved back panel 51. The lower front edges of the side panels have a removable front panel 53 bolted therebetween for purposes as will appear. Preferably, back panel 51 is sealably secured to the outer curved edges of the side panels by means of Pittsburgh-type seams so as to positively interlock the side panels to the back panel and to effectively seal out moisture. A plurality of bolt holes 57 is provided in the lower portions of side panels 49*a*, 49*b* so as to mate with corresponding bolt holes in vent flanges 41 of base frame 39 thereby to mount the roof vent body 33 on the base frame.

Figure 7A:
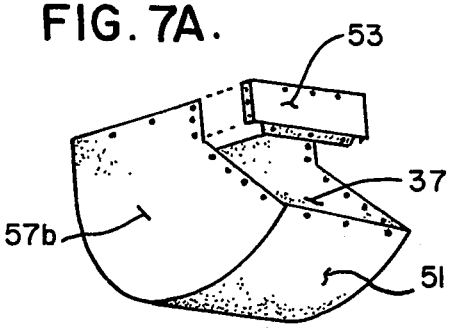
FIGS. 7A–7E illustrate the various steps in assembling and installing a roof vent of the present invention on a roof panel.
Figure 7B:
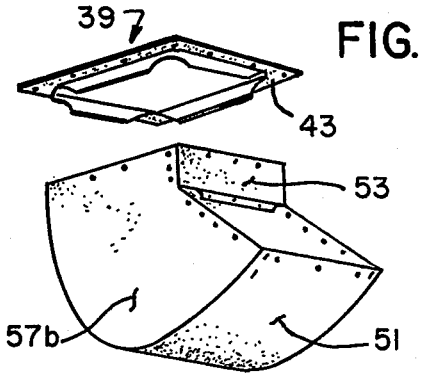
Figure 7C:
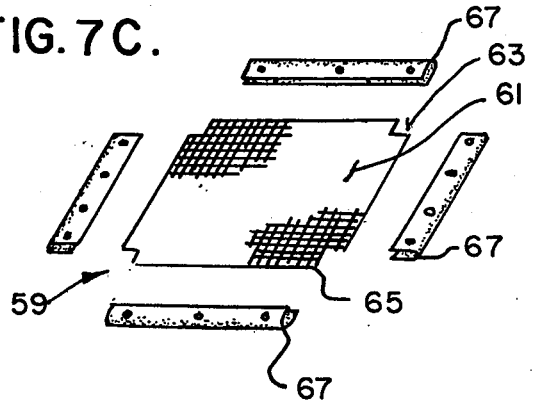
Figure 7D:
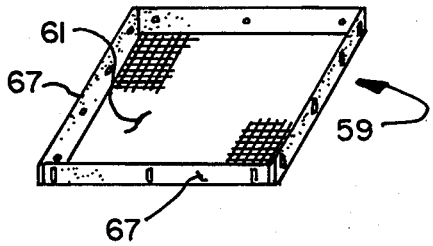
Figure 7E:
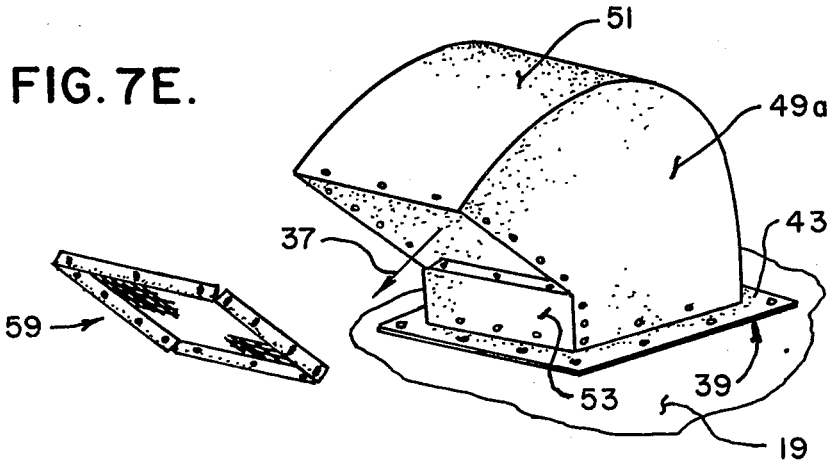

Further, roof vent 15 includes a removable bird screen assembly, as generally indicated at 59, and as best illustrated in FIGS. 7C–7E. More specifically, this screen assembly includes a screen 61 of sufficient mesh size so as to prevent birds and other pests from entering the grain bin, but yet so as to permit dust and grain fines to be readily exhausted from the grain bin during the drying operation thereby to prevent clogging of the screen. As shown in FIG. 7C, the screen assembly may be optionally shipped in a knocked down condition and it is shown to include the flat screen member 61 having notches 63 cut in its corners. The edges of the screen are indicated at 65. So-called screen brackets 67 are fitted onto respective screen edges 65 and then, as shown in FIG. 7D, the brackets and screen edges are bent upwardly thereby to form a raised framework around screen 61. This framework is then bolted into place on the outlet end 37 of roof vent body 33 so as to secure it into place and onto the upper edge of front panel 53 of the grain bin body. This assembly step is best shown in FIG. 7E.

While at first glance, roof vent 15 is shown to be of generally rectangular cross-section, it is, in accordance with at least one aspect of this invention, formed to be of trapezoidal cross-section. As shown in FIG. 5, the include angle A between the sideplates 49*a*,49*b* and the backplate 51, is generally greater than 90 degrees. This in turn defines a trapezoidal shape between the side panels 49*a*, 49*b* and the back panel 51 of the roof vent body. Likewise, opening 25 provided in the one roof panel 9, as shown in FIG. 2, also is of generally trapezoidal shape so as to mate with the trapezoidal opening or air passage 34 defined by roof vent body 33. As indicated, the two upper corners (as shown in FIG. 2) of opening 25 have an included angle A therebetween so as generally to mate with the inlet opening 35 of roof vent body 33.

As a result of the trapezoidal shape of roof vent body 33 and further as a result of the roof vent body being shipped free of front panel 53 and bird screen 59 (these last-mentioned parts being referred to generally as removable front members), a plurality (e.g., five) of identically sized roof vent bodies 5 may be nested, one within the other, as shown in FIG. 6 such that this grouping of roof vents may be placed in a single shipping container (not shown) along with their respective front panels 53, bird screens 59, and other associated hardware. Thus, the roof vent bodies 33 of the present invention may be shipped to the installation site in a substantially assembled condition thereby eliminating significant field assembly and facilitating construction of the grain bin. It will be understood that oftentimes a single grain bin will require a plurality of roof vents 15 and the capability of being able to ship all of the roof vents required for a particular grain bin in a single package or container and with these roof vent bodies being substantially assembled at the factory, considerable labor savings can be realized and the possibility of damage to the roof vents during shipping is lessened. Further, by shipping a number of roof vent bodies in a nested condition in a single shipping container or box saves considerably in shipping volume and greatly lessens damage to the roof vent bodies during shipping.

Referring now to FIGS. 7A–7E, the assembly and installation of a roof vent 15 of the present invention on grain bin 1 will now be described. First, the roof vent body 33 is removed from the nested roof bodies (as shown in FIG. 6) and the front panel 53 is bolted in place between side plates 49*a*, 49*b*. Then, with the roof vent inverted, as shown in FIG. 7B, flanges 41 of base frame 39 are installed in the inlet opening 35 of roof vent body 33 and are bolted into place. Screen assembly 59 is assembled, as heretofore described and as is shown in FIGS. 7C and 7D, and is installed in the outlet opening 37 of air passage 34 through roof vent body 33. Then, the roof vent is installed on the outer surface of roof panel body 19 in the manner best shown in FIG. 3 and is rigidly bolted in place.

Figure 8:
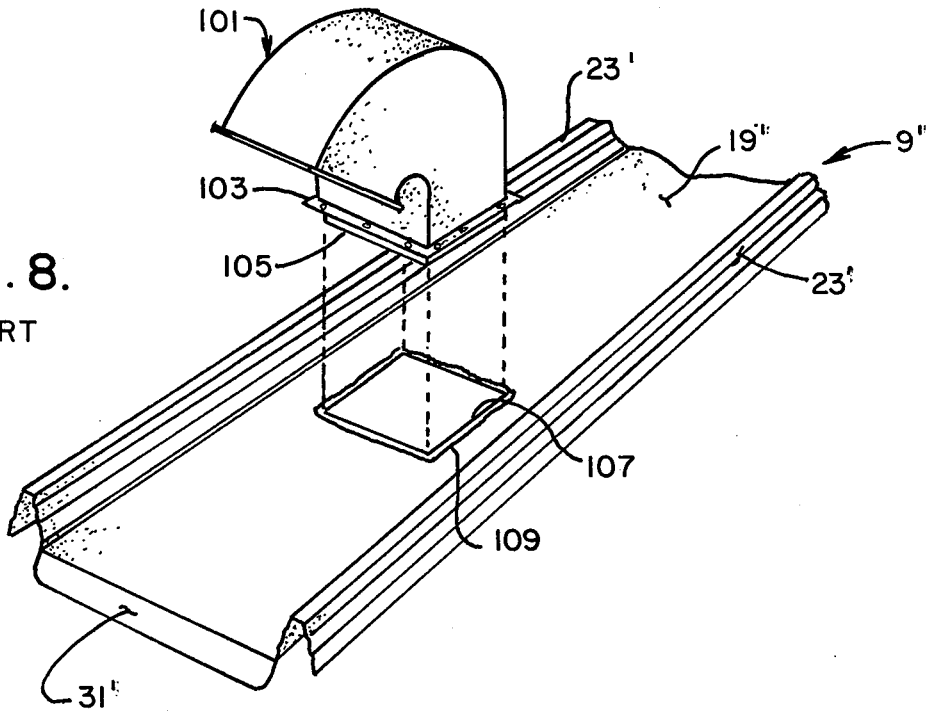
FIG. 8. PRIOR ART
FIG. 8 is a partially exploded view of a prior art roof vent as it is installed in a field made opening in a roof panel.
Figure 9:
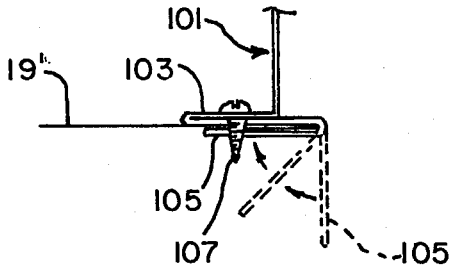
FIG. 9 PRIOR ART
FIG. 9 is an enlarged cross-sectional view of the attachment of the prior art roof vent to the roof panel.

Turning now to FIGS. 8 and 9, a typical prior art roof vent, as indicated in its entirety by reference character 101, is illustrated as it is installed on a roof panel 9'. It will be understood that the "primed" reference characters indicate parts having a corresponding construction and function as parts heretofore described. Prior art roof vent 101 is shown to have a flashing flange 103 extending outwardly around its base and further has a protrusion 105 extending downwardly below flashing flange 103. As is typical in the installation of prior art roof vents 101, an opening 107 is typically hand cut in body panel 19'' of roof panel 9'' at a desired location during field erection of the bin. Oftentimes, a template is provided so as to provide a guide for field installation personnel in cutting opening 107 by means of tin snips or the like. As indicated at 109, a bead of a suitable mastic-like caulking compound is applied on the outer surface of panel body 19' surrounding opening 107. The roof vent 101 is then installed in opening 107 such that the lower face of flashing flange 103 engages the upper face of body panel 19' surrounding opening 107 and such that the protrusions 105 extend down through the opening 107 into the interior of the grain bin. The installation personnel are then instructed to bend the protrusion over from its vertical dotted line position (as shown in FIG. 9) into its solid line position in which the body panel 19' is sandwiched between the lower face of flashing flange 103 and protrusion 105. Then, suitable metal screws are installed through the flashing flange, through the body panel, and through the protrusion so as to securely fasten the roof vent in place on the roof panel. However, it will be appreciated that holes must be drilled in the field through the flashing flange 103, through the roof panel 19', and through the protrusion 105. Also, it will be appreciated that due to the necessity of cutting opening 107 in the body panel 19' in the field, the installation of the prior art roof vent 101 is oftentimes a complicated and time-consuming operation. Also, in the event longitudinal corrugations 21' are provided in panel body 19', the mastic between flashing flange 103 and body panel 19' may not be sufficient to positively prevent rainwater or the like flowing down the sloped body panel and from leaking into the grain bin by flowing under the flashing panel and in through opening 107.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

I claim:

1. In a grain bin having a generally cylindrical bin body and a conical roof, said roof comprises a plurality of panels secured together in side to side relation, wherein the improvement comprises: at least one of said roof panels having an opening therein, a flange continuously sealably secured relative to said one roof panel and projecting outwardly therefrom so as to define said opening, said roof panel flange preventing water from flowing down said roof and into said opening, and a roof vent for being secured to said one roof panel in register with said opening, said roof vent comprising a body defining an air passageway therethrough, one end of said body constituting the inlet of said air passage and the other end of said body constituting the outlet of said air passage, said roof vent further comprising a base frame having flanges secured to said inlet end of said roof vent body and flashing flanges secured to said base frame flanges, said flashing flanges being secured to the outer face of said one roof panel around said opening and said base frame flange being disposed proximate to and outboard from said roof panel flange.

2. In a grain bin as set forth in claim 1 wherein said base frame is a one-piece member with said vent flanges integral with said flashing flanges.

* * * * *